United States Patent [19]

Brealey

[11] Patent Number: 4,477,692

[45] Date of Patent: Oct. 16, 1984

[54] HIGH VOLTAGE TERMINAL BUSHING FOR ELECTRICAL APPARATUS

[75] Inventor: Robert H. Brealey, Exton, Pa.

[73] Assignee: General Electric Company, King of Prussia, Pa.

[21] Appl. No.: 285,646

[22] Filed: Jul. 21, 1981

[51] Int. Cl.[3] ..... H01B 17/26

[52] U.S. Cl. ..... 174/31 R; 174/142

[58] Field of Search ..... 174/31 R, 142, 152 R, 174/DIG. 10

[56] References Cited

U.S. PATENT DOCUMENTS

| | | | |
|---|---|---|---|
| 3,086,073 | 4/1963 | Arone et al. | 174/142 |
| 3,456,222 | 7/1969 | Berg | 336/92 |

FOREIGN PATENT DOCUMENTS

| | | | |
|---|---|---|---|
| 1145823 | 5/1983 | Canada | 174/142 |
| Ad.27471 | 3/1924 | France | 174/142 |
| 744414 | 1/1933 | France | 174/31 R |
| 55-27692 | 2/1980 | Japan | 174/31 R |

*Primary Examiner*—Laramie E. Askin

*Attorney, Agent, or Firm*—William Freedman

[57] ABSTRACT

This high-voltage terminal bushing comprises a tubular shell of electrical insulating material having a passageway extending between its ends and an electrical conductor within the passageway that has an external surface spaced from the internal surface of the passageway. The external surface of the conductor is covered with a thin coating of insulating material spaced from the internal surface of the passageway by a cylindrical air gap. The coating has sufficient dielectric strength to prevent any corona streamers from the conductor from impinging against said internal surface at impulse voltages up to the rated impulse insulation level of the bushing.

5 Claims, 1 Drawing Figure

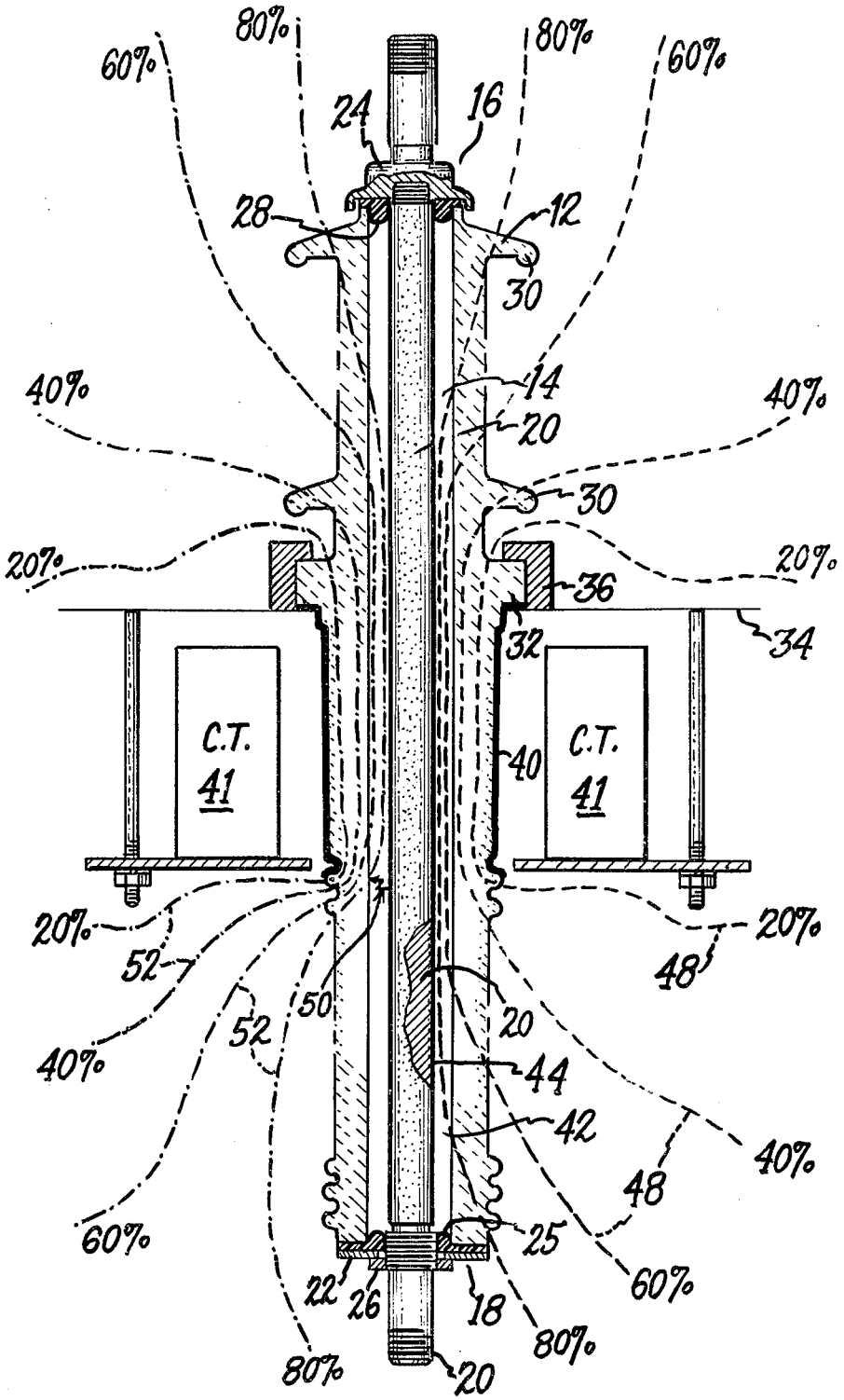
80%
80%
60%
60%
24
16
28
12
30
40%
14
40%
20
30
20%
20%
36
34
32
C.T.
41
C.T.
41
40
20%
20%
52
48
50
20
52
40%
44
42
40%
48
60%
25
60%
22
26
18
80%
80%
20

HIGH VOLTAGE TERMINAL BUSHING FOR ELECTRICAL APPARATUS

BACKGROUND

This invention relates to a high-voltage terminal bushing for electrical apparatus and, more particularly, relates to means for improving the ability of such a bushing to withstand impulse voltages without external flashover.

A typical high-voltage terminal bushing comprises a tubular shell of electrical insulating material containing a central passageway extending between opposite ends of the bushing and an electrical conductor extending between said ends via the passageway. In the type of bushing that I am concerned with, there is a cylindrical gap containing gaseous dielectric, such as air, between the conductor and the internal wall of the central passageway. Such bushings must be able to withstand relatively high values of impulse voltage. For example, according to American National Standard C37.06-1971, a bushing for an outdoor circuit breaker having a rated maximum voltage of 15.5 kV rms must be able to withstand a full wave impulse voltage of 110 kV and a 2 microsecond chopped wave impulse voltage of 142 kV, the impulse tests being made with a 1.2×50 microsecond wave. These values of impulse voltage, in part, constitute what is commonly referred to as the rated impulse insulation level of the bushing. In working with certain bushings of the above type, I have encountered flashovers along the external surface of the bushing when impulse voltages approaching the rated impulse insulation level were applied between the conductor and ground. Conventional approaches for inhibiting such external flashovers are to lengthen the external surfaces of the insulating shell, or to change their configuration, or to change the shape of the electrodes at the boundaries of these surfaces. Such approaches involve extensive modification and redesign of the bushing and tend to be rather expensive.

SUMMARY

An object of my invention is to provide simple and inexpensive means for inhibiting external flashovers of the bushing that require no lengthening or other changes in the external surface of the bushing and no changes in the shape of the electrodes at the boundaries of the external surface.

In carrying out my invention in one form, I provide the bushing conductor of the above-described bushing with a thin coating of electrical insulating material that is spaced from the internal surface of the central passageway by a cylindrical gap containing gaseous dielectric. This coating has sufficient dielectric strength to prevent any corona streamers from the central conductor that are developed by impulse voltages up to the rated impulse insulation level from impinging against the internal surface of the central passageway. Such corona streamers can detrimentally change the electrical field configuration at the external surface of the bushing; and by preventing the formation of such streamers, I am able to prevent such detrimental changes in field configuration as cause external flashovers.

BRIEF DESCRIPTION OF DRAWING

For a better understanding of the invention, reference may be had to the following description taken in conjunction with the accompanying drawing, wherein:

The single figure is a partially schematic and partially sectional side elevation view of a high voltage bushing embodying one form of the present invention.

DETAILED DESCRIPTION OF PREFERRED EMBODIMENT

Referring now to the drawing, the high-voltage terminal bushing illustrated therein comprises a tubular shell 12 of porcelain or other good electrical insulating material. This shell 12 contains a central passageway 14 extending between opposite ends 16 and 18 of the bushing. Also extending between the opposite ends 16 and 18 is an electrical conductor 20 located within the central passageway.

Suitable end caps 22 and 24 are provided for mounting the conductor 20 within the central passageway 14. The lower end cap 22 and a gasket 25 atop the lower end cap are clamped between the lower end of the shell 12 and a mounting nut 26, which is threaded onto the lower end of the central conductor 20. The upper end cap 24 is threaded onto the upper end of the central conductor 20, and a gasket 28 is clamped between the upper end of the shell 12 and the upper end cap 24.

The upper end of the shell 12 is provided with suitable petticoats 30 on the exterior of the shell. These petticoats (only some of which are shown) serve the conventional function of providing the desired creepage distance along this surface under adverse weather conditions. Centrally of the length of the shell, there is a radially-extending flange 32 integral with the shell for mounting the bushing. Typically, this flange 32 is seated on the usual metal cover 34 of electrical apparatus, and a suitable clamp 36 secures the flange to the cover. The cover 34 and the clamp 36 are schematically illustrated.

The illustrated bushing shell 12 is provided with a conductive coating 40 that surrounds the shell adjacent the flange 32 and covers the lower surface of the flange. In most electrical apparatus, this coating 40, the tank cover 34, and the clamp 36 are at ground potential. Typically, one or more current transformers, such as 41, of annular form are mounted around the shell 12, surrounding the cylindrical portion of coating 40.

Surrounding the conductor 20 and located between the conductor 20 and the internal surface of passageway 14 is a cylindrical gap 42 containing gaseous dielectric, typically air. In accordance with my invention, the conductor 20 is provided with an external coating 44 of electrical insulating material which is bonded to the conductor 20 and is surrounded by the air gap 42.

The conventional terminal bushing has no coating on its conductor 20, this conductor being essentially bare. In testing such bushings for their ability to withstand impulse voltages without dielectric breakdown, I have encountered anomolous external flashovers as the value of the impulse voltage has been raised to the neighborhood of the rated impulse insulation level required by industry standards. Typically, such flashovers occurred along the external surface of shell 12 between the lower end of metal coating 40 and the lower end cap 22 or the lower end of conductor 20. It is possible to inhibit such external flashovers by lengthening the external surface of the shell 12 or by changing the configuration of this surface or by changing the shape of the electrodes (40, 22, 24) bounding such surface. These are conventional approaches, but such approaches involve extensive modification and redesign and tend to be rather expensive and to require space which may not be available.

I use an approach that is very different from the above-described conventional approaches for raising the value of impulse voltage that can be withstood without external flashover. More specifically, I provide the conductor 20 with the abovedescribed insulating coating 44. This coating has sufficient dielectric strength to prevent any corona streamers from the conductor 20 from impinging against the internal surface of the passageway 42. In a typical embodiment of the invention, I use an epoxy material for the coating and a coating thickness of approximately 20 mils.

My studies show that if a corona streamer from the conductor 20 impinges against the internal surface of the passageway 14, it, in effect, shorts out the air gap 42. With the air gap 42 shorted out, the voltage between the conductor 20 and the grounded structure 34, 36, 40, which had previously been applied to the series combination of the air gap 42 and the porcelain of the shell, is then applied entirely to the porcelain. This results in a drastic change in the configuration of the electric field at the interface of the shell 12 and the surrounding air and, more specifically, in a change which significantly increases the strength of the electric field at said interface and in the region adjacent the grounded structure. This increased electric field strength is often sufficient to produce a damaging flashover along the external surface of the shell 12.

By providing the above-described insulating coating 44 on the conductor 20, I am able to suppress corona from the conductor 20 and to prevent any corona that is developed by high impulse voltages up to the rated impulse insulation level required by industry standards from propagating radially outward across air gap 42 in the form of corona streamers that impinge against the internal surface of the passageway 14. The bushing is of such a design that without the coating, such corona streamers will be developed at impulse voltages beneath the rated impulse insulation level required by industry standards.

For effectively precluding the development of the above-described corona streamers, the portion of the coating in the region adjacent the grounded structure 40, 36 should be free of holes even as small as the type of tiny holes referred to as pin holes. To provide a reasonable assurance of such freedom from pin holes, I make the coating at least 10 mils in thickness.

In a preferred form of my invention, the coating 44 is of a bisphenol A epoxy having a dielectric constant of about 4.0 and a dielectric strength of about 1200 volts/-mil of thickness. This coating is applied by a conventional electrostatic spraying process, where the conductor 20, heated to an appropriate temperature, is sprayed with powders of the coating material. The coating is, of course, applied prior to assembly of the conductor in the bushing.

Although the illustrated coating 44 extends for the full length of the conductor 20 that is within the shell 12, it is not essential that the full conductor length be covered. It is only necessary that the intermediate portion of the length adjacent the grounded structure 40, 34, 36 be covered since it is only in this intermediate region that there are developed under impulse conditions the relatively high electrical stresses that have the potential for producing the above-described corona streamers.

To better illustrate the above-described effect on the electric field of corona streamers in the gap 42, I have shown in the drawing equipotential lines of the electric field under two different conditions. The first condition is the normal one; and under this condition, the electric field has equipotential lines 48 of the approximate shape shown to the right of the central conductor 20. Each equipotential line 48 is labeled with the approximate percentage of the total potential between high voltage conductor and ground that it represents. The second condition is one in which a corona streamer (50) from the central conductor 20 is assumed to have propagated across the air gap 42 and to have impinged against the internal surface of passageway 14. Under this second condition an electric field is developed which has equipotential lines 52 of the approximate shape shown to the left of the central conductor 20.

It will be noted that under the normal condition depicted to the right of the conductor 20, the equipotential lines 48 flare radially outward rather gently around the lower end of the cylindrical grounded shield 40, being rather uncrowded in this region. But under the corona impingement conditions depicted to the left of the conductor 20, the equipotential lines 52 of the electric field in the region at the lower end of shield 40 extend radially outward much less gradually, tending to crowd around the lower end of the shield 40. The net effect of this crowding is a relatively high field strength adjacent the lower end of shield 40. This strengthened field is often sufficient to produce a damaging flashover along the lower external surface of the porcelain shell between the lower end of shield 40 and the conductive structure at the lower end of the bushing.

Although the corona streamer 50 is shown in the illustrated bushing, it is to be understood that this showing is primarily for discussion purposes and that the insulating coating 44 is provided to prevent the formation of such a streamer. It is with a bushing having a bare conductor that I have detected the formation of such streamers under severe impulse voltage conditions.

Many types of electrical equipment comprise spaced electrodes immersed in a gaseous dielectric and between which high voltages are applied. I am aware that insulating coatings have heretofore been applied to the electrodes of such apparatus to reduce the chances for a sparkover or flashover between the electrodes. But such application of an insulating coating is significantly different from that which is present in a high voltage bushing such as described hereinabove inasmuch as the latter bushing relies primarily for its insulation upon already-present solid insulation (the porcelain of shell 12) interposed in all possible breakdown paths between its internal high-potential structure (20) and its external low-potential structure (40, 36). Such solid insulation is not usually present in the above-described prior apparatus where coatings have been used. At any rate, I am not aware of the use of an insulating coating on an internal conductive part enclosed by an insulating shell to preclude flashovers along the external surface of the shell, and this is generally the purpose for which I use my insulating coating.

While I have shown and described a particular embodiment of my invention, it will be obvious to those skilled in the art that various changes and modifications may be made without departing from my invention in its broader aspects; and I, therefore, intend herein to cover all such changes and modifications as fall within the true spirit and scope of my invention.

I claim:

1. In a high-voltage terminal bushing, a tubular shell of electrical insulating material having a pair of opposed ends and a central passageway extending between said ends, an electrical conductor extending between said ends via said central passageway, means including a pair of metal end caps at the opposite ends of said insulating shell and at opposite ends of said conductor for mounting said conductor within said central passageway, said conductor having an external surface that is spaced from the internal surface of said passageway, grounded structure disposed externally of said shell at a location intermediate the ends of the shell, said bushing being so constructed that said insulating shell is disposed in all potential electrical breakdown paths between said grounded structure and the portion of said conductor within said central passageway, a thin coating of electrical insulating material covering and bonded to said external surface of the conductor and spaced from said internal surface of the passageway by a cylindrical gap containing gaseous dielectric that is dielectrically stressed in the region of said grounded structure when the bushing is energized, said coating being located in a position between said end caps and having a thickness of at least about 10 mils covering at least the entire portion of the external surface of said conductor that is located in the region of said grounded structure, said coating having a sufficient dielectric strength to prevent any corona streamers from said conductor from impinging against said internal surface of said passageway at impulse voltages up to the rated impulse insulation level required by industry standards, the bushing being of such design that without said coating, impulse voltages beneath said rated impulse insulation level produce corona streamers from said conductor that impinge against said internal surface of said passageway.

2. The bushing of claim 1 in which said insulating coating is about 20 mils in thickness.

3. The bushing of claim 1 in which the portion of the coating that is located in the region of said grounded structure is free of perforations, including pin holes.

4. The terminal bushing of claim 1 in which said metal end caps have metal surfaces exposed to the external space surrounding the bushing.

5. A bushing as defined in claim 1, 2, 3 or 4 and having a rated maximum voltage of 15.5 kV rms and a rated impulse insulation level of at least 110 kV full wave impulse voltage and at least 142 kV on a 2 microsecond chopped wave impulse voltage, the impulse tests being made with a 1.2×50 microsecond wave.

* * * * *